United States Patent [19]

Mayrhofer et al.

[11] Patent Number: 4,846,065

[45] Date of Patent: Jul. 11, 1989

[54] PRINTING IMAGE CARRIER WITH CERAMIC SURFACE

[75] Inventors: Otto Mayrhofer; Hartmut Fuhrmann, both of Karlsfeld; Reinhard Plaschka, Neuried, all of Fed. Rep. of Germany

[73] Assignee: MAN Technologie GmbH, Munich, Fed. Rep. of Germany

[21] Appl. No.: 103,812

[22] Filed: Oct. 1, 1987

[30] Foreign Application Priority Data

Oct. 23, 1986 [DE] Fed. Rep. of Germany ..... 3636129

[51] Int. Cl.[4] ..... B41N 1/14

[52] U.S. Cl. ..... 101/453; 101/467

[58] Field of Search ..... 101/453, 467

[56] References Cited

U.S. PATENT DOCUMENTS

| | | | |
|---|---|---|---|
| 316,251 | 4/1885 | Eberle | 101/467 |
| 459,239 | 9/1891 | Mullaly | 101/459 |
| 748,004 | 12/1903 | Pancoast | 101/459 |
| 2,344,510 | 3/1944 | Hagelin | 101/459 |
| 2,584,317 | 2/1952 | Allen | 101/459 |
| 3,223,032 | 12/1965 | Boardman | 101/459 |
| 3,229,628 | 1/1966 | Mundell | 101/459 |
| 3,280,736 | 10/1966 | Schafler | 101/459 |
| 3,441,940 | 4/1969 | Salaman | 101/467 |
| 3,929,594 | 12/1975 | Fromson | 101/458 |
| 3,968,278 | 7/1976 | Wells | 101/465 |
| 4,082,040 | 4/1978 | Yamashina | 101/459 |
| 4,537,127 | 8/1985 | Fadner | 101/451 |

*Primary Examiner*—Clifford D. Crowder

*Attorney, Agent, or Firm*—Scully, Scott, Murphy & Presser

[57] ABSTRACT

Printing image carriers for surface printing which have a water accepting surface adapted to have ink accepting surface elements transferred to it by the action of heat and pressure. In order to ensure reliable transfer of such layers keeping to precisely delimited outlines the printing image carrier is of a material which is thermally insulating and whose surface accepts water. The result is the avoidance of excessively rapid conduction away of the heat input from a pressing head which would otherwise be likely to interfere with a precisely delimited transfer of an oleophilic layer or to generally prevent the application of such a layer.

2 Claims, 1 Drawing Sheet

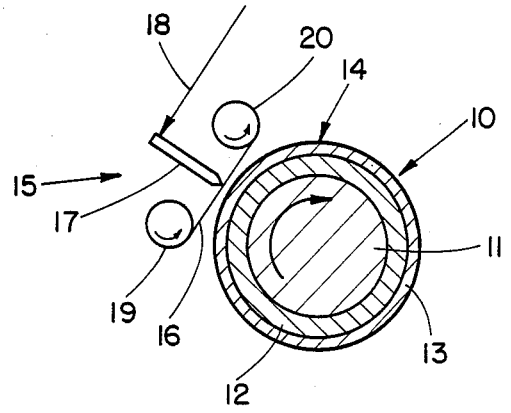
18
20
14
10
15
17
11
19
16
13
12

PRINTING IMAGE CARRIER WITH CERAMIC SURFACE

BACKGROUND OF THE INVENTION

The invention relates to a printing image carrier for surface printing having a hydrophilic surface on which ink accepting elements may be applied by the acting of heat and pressure.

The German Pat. No. 3,248,178 describes printing image carriers of this type on which deletion is possible and which may be modified within the printing press for changing the printing image. In the known system a heating and pressing head and a thermotransfer foil are used to transfer hydrophobic surface elements to the hydrophilic surface of the printing image carrier under the action of heat and pressure. The heating and pressing head produces heat at given points so that with the aid of the thermotransfer foil individual ink accepting dots are applied to the hydrophilic surface.

However it has been found that the areas so applied in this manner are not homogeneously hydrophobic and furthermore do not have clear-cut boundaries.

SHORT SUMMARY OF THE PRESENT INVENTION

One object of the present invention is to so improve upon a printing image carrier of the initially mentioned type that a faithful transfer of graphic material and lettering images is possible.

In order to achieve these or other objects appearing herein, in the invention at least the outermost layer of the printing image carrier consists of a material which has thermally insulating properties and a hydrophilic character.

The invention is based upon the discovery that in the prior art so far on the transfer of heat dot by dot by means of the heating and pressing head the heat is conducted away by the metal printing image carrier at an excessive rate. Accordingly the temperature reached at the dots is not sufficient to detach the layer, which is provided for the application of the hydrophobic or oleophilic surface elements of the printing image carrier, from the thermotransfer band.

The invention makes possible a rapid conduction away of the heat produced by the heating and pressing head and ensures a dot by dot transfer with sharp boundaries of the layer on the thermotransfer band to the printing image carrier in every case.

In accordance with a first possible embodiment of the invention the cylinder for carrying the printing image carrier or the printing plate is made of a material with thermally insulating properties and a hydrophilic carrier. From the manufacturing aspect this is the simplest way of putting the invention into effect, the surface of the printing plate cylinder or the printing plate forming the printing image carrier.

In order not to limit the free selection of the material for the cylinder or the printing plate, the same may be made of any desired material and coated with a material with thermally insulating properties and a hydrophilic character.

It has furthermore turned out that the one or the other form of the invention as mentioned above may be combined with a thin metallic layer which may be applied to the material. This metallic layer, which may be applied with a conventional method such vapor coating, constitutes a good foundation for the application of the oleophilic areas. By selecting the thickness of the metallic layer to be a few microns, as for example of the order of 10 microns, it is on the other hand possible to ensure that there is no conduction away of the heat in the lateral direction. Aluminum may for example be used for the metallic layer.

The thermally insulating material may for example be a ceramic material, a plastic or a metallic oxide. If the material forms the printing surface of the printing image carrier, it is then necessary for the material to additionally have a good hydrophilic character. The materials used should furthermore be resistant to mechanical contact in order to avoid a premature wear of the printing image carrier.

DETAILED ACCOUNT OF WORKING EXAMPLE OF THE INVENTION

The drawing shows one working example of the invention diagrammatically.

A printing plate or form cylinder 10 is shown in cross section which has a core 11 of any suitable material, as for example iron with a printing image carrier placed thereon. The printing image carrier for its part is made up of a combined structure with inner and outer layers 12 and 13, respectively. The inner layer 12 of the printing image carrier consists of a material with good thermal insulating properties, as for instance a plastic, a metal oxide or a ceramic material. The second layer (13), which is very thin and has a thickness in the order of 10 microns, is applied to the thermally insulating layer 12 of the printing image carrier. This second layer 13 consists of a metal or other material with a hydrophilic character as for instance aluminum, aluminum oxide or chromium. This combination (14 and 15) forming the printing image carrier thus has a surface 14 which has a hydrophilic character and is all in all thermally insulating, the outer metallic layer 13 hardly being able to make any contribution to the conduction of heat owing to its low thickness.

Such a printing cylinder 10 is associated with an image information transmitting unit 15 within the printing press, by way of which the image information in the form of ink accepting area elements is transferred to the surface of the printing image carrier 12 and 13.

The transfer unit 15 consists of foil 16 with a thermo- or electrothermosensitive coating, which has the oleophilic, that is to say ink accepting properties, and a pressing head 17 which may be a heating rod, an electrode, and energy beam or another heating producing means.

For transfer of the image information the pressing head 17 is operated by the respective image signals 18 so that for each image dot it heats and applies pressure to the foil 16 for dotwise transfer of the coating of the foil to the surface 14 of the printing image carrier 12 and 13, where it remains anchored in position. The foil 16 is fed from the reserve and paying out cylinders 19 and 20, respectively. The layer applied to the printing image carrier 12 and 13 in this manner forms the ink accepting area elements.

The formation of the printing image carrier or of the cylinder therefor may take place in various manners. In place of layers with different properties the entire cylinder may be made homogeneously of a single material which possesses both the properties, that is to say the thermal insulating property and the hydrophilic one. However it also possible for merely the cylinder surface to be coated with such a material. In any event it is important that the surface of the printing image carrier of the cylinder be able to accept water and that, as far as is possible, the heat introduced via the pressing head not be conducted away. It is in this way that it is possible to ensure that with a suitably controlled input of heat there is a transfer of the thermolayer to the surface of the printing image carrier in a secure manner and with a clear delimitation.

The disclosure of the above specification relating to a printing image carrier in the form of a cylinder naturally applies also for plates as printing image carriers to an equal degree.

We claim:

1. A printing image carrier for surface printing having a hydrophilic surface which carries water during the printing process, to which there is transmitted prior to the printing process under the concurrent action of heat and applied pressure, hydrophobic ink accepting area elements from a suitably coated thermotransfer foil, wherein at least the outer layer of the printing image carrier which contains the printing surface is constituted of a ceramic material which has effective thermal insulating properties as well as hydrophilic properties to carry water during the printing process.

2. A printing image carrier as claimed in claim 1, wherein the ceramic material is coated with a coating having a thickness in the order of 10 microns from a metallic material selected from the group of aluminum, aluminum oxide, and chromium, which intensifies the hydrophilic character of the ceramic material.

* * * * *